United States Patent [19]

Yamamoto et al.

[11] 4,434,779

[45] Mar. 6, 1984

[54] CIRCUIT FOR CONTROLLING THE PRIMARY DWELL TIME OF IGNITION TRANSFORMER

[75] Inventors: Norboru Yamamoto, Kariya; Tomoatsu Makino, Okazaki; Ryoichi Okuda, Kariya, all of Japan

[73] Assignee: Nippondenso Co., Ltd., Kariya, Japan

[21] Appl. No.: 352,454

[22] Filed: Feb. 25, 1982

[30] Foreign Application Priority Data

Feb. 27, 1981 [JP] Japan ..... 56-28901

[51] Int. Cl.[3] ..... F02P 1/00

[52] U.S. Cl. ..... 123/609; 123/611

[58] Field of Search ..... 123/609, 610, 611

[56] References Cited

U.S. PATENT DOCUMENTS

| | | | |
|---|---|---|---|
| 3,939,811 | 2/1976 | Sasayama | 123/609 |
| 4,212,280 | 7/1980 | Fresow | 123/611 |
| 4,245,600 | 1/1981 | Katada | 123/611 |
| 4,267,813 | 5/1981 | Hohne | 123/609 |
| 4,275,701 | 6/1981 | Arguello | 123/609 |
| 4,351,287 | 9/1982 | Shirasaki | 123/611 |

*Primary Examiner*—Ronald B. Cox

*Attorney, Agent, or Firm*—Cushman, Darby & Cushman

[57] ABSTRACT

A circuit arrangement for controlling the duration of a current generated in the primary winding of an ignition transformer comprises a ramp generator responsive to the ignition timing or an internal combustion engine for generating a ramp voltage having a constant peak value and a variable rate of increase in voltage as a function of the speed of the engine. A pulse generating means is provided for successively generating a pulse of which the pulse height is substantially equal to the peak value of the ramp voltage and of which the pulse duration is variable inversely as a function of the speed of the engine. To the pulse generating means is coupled an integrator for integrating the pulses supplied thereto to generate an integrated output. The output of the integrator is supplied to a comparator for making a comparison with the instantaneous value of the ramp voltage to generate an ignition current pulse having a duration corresponding to the difference between the compared input variables.

9 Claims, 4 Drawing Figures

CIRCUIT FOR CONTROLLING THE PRIMARY DWELL TIME OF IGNITION TRANSFORMER

BACKGROUND OF THE INVENTION

The present invention relates generally to ignition systems for automotive internal combustion engines, and specifically to a circuit arrangement for controlling the primary dwell time of an ignition transformer substantially at a constant value.

It is generally known in the art that in conventional ignition current control systems the primary dwell time of ignition transformer is detected and compared with a reference interval to detect the difference between them. The prior art systems include a negative feedback circuit which controls the duration of the ignition primary current so that the difference is reduced to a minimum. With the feedback operation the duration of the ignition primary current is substantially controlled to a desired constant value that ensures ignition at all engine speeds.

However, the amount of the output variable of the closed-loop system needs to be controlled to within a relatively narrow range to prevent undesirable effects of system's hunting and this in turn requires the system's component parts to be manufactured to strict tolerances and adjusted constantly during operation to keep them in specified operating conditions.

SUMMARY OF THE INVENTION

The primary object of the invention is to provide an improved circuit arrangement for controlling the duration of an ignition primary current which overcomes the problems associated with the feedback-controlled ignition current control system.

According to the present invention, the circuit arrangement comprises a ramp generator responsive to the ignition timing of the internal combustion engine for generating a ramp voltage having a constant peak value and a variable rate of increase in voltage as a function of the speed of the engine. A pulse generating means is provided for successively generating a pulse of which the pulse height is substantially equal to the peak value of the ramp voltage and of which the pulse duration is variable inversely as a function of the speed of the engine. To the pulse generating means is coupled an integrator for integrating the pulses supplied thereto to generate an integrated output. The output of the integrator is supplied to a comparator for making a comparison with the instantaneous value of the ramp voltage to detect a difference therebetween. An ignition current pulse having a duration corresponding to the detected difference is generated in the primary winding of an ignition transformer. Since the rate of increase in ramp voltage is proportional to the engine speed while the output of the integrator is inversely proportional to the engine speed, the ignition current pulse is controlled to a substantially constant value at all engine speeds.

The present invention requires that the ramp voltage have a constant peak value and that the input to the integrator be derived from a pulse having a pulse height which is controlled to a value substantially equal to the peak value of the ramp voltage. The output of the integrator is rendered variable with the peak value of the ramp voltage and hence with its rate of voltage increase so that when the system is subjected to variations in power supply voltage and in circuit operating parameters such variations tend to automatically readjut the relative values of the inputs to the comparator to keep the duration of the ignition current pulse at a constant value.

In a preferred embodiment, the input to the integrator is derived from a circuit comprising a pulse generator for generating a constant-duration pulse in response to the ignition timing and means for inverting the polarity of the constant-duration pulse and clamping the pulse height of the polarity inverted pulse to the peak value of the ramp voltage.

BRIEF DESCRIPTION OF THE DRAWINGS

The invention will be described in further detail with reference to the accompanying drawings, in which.

DETAILED DESCRIPTION

Figure 1:
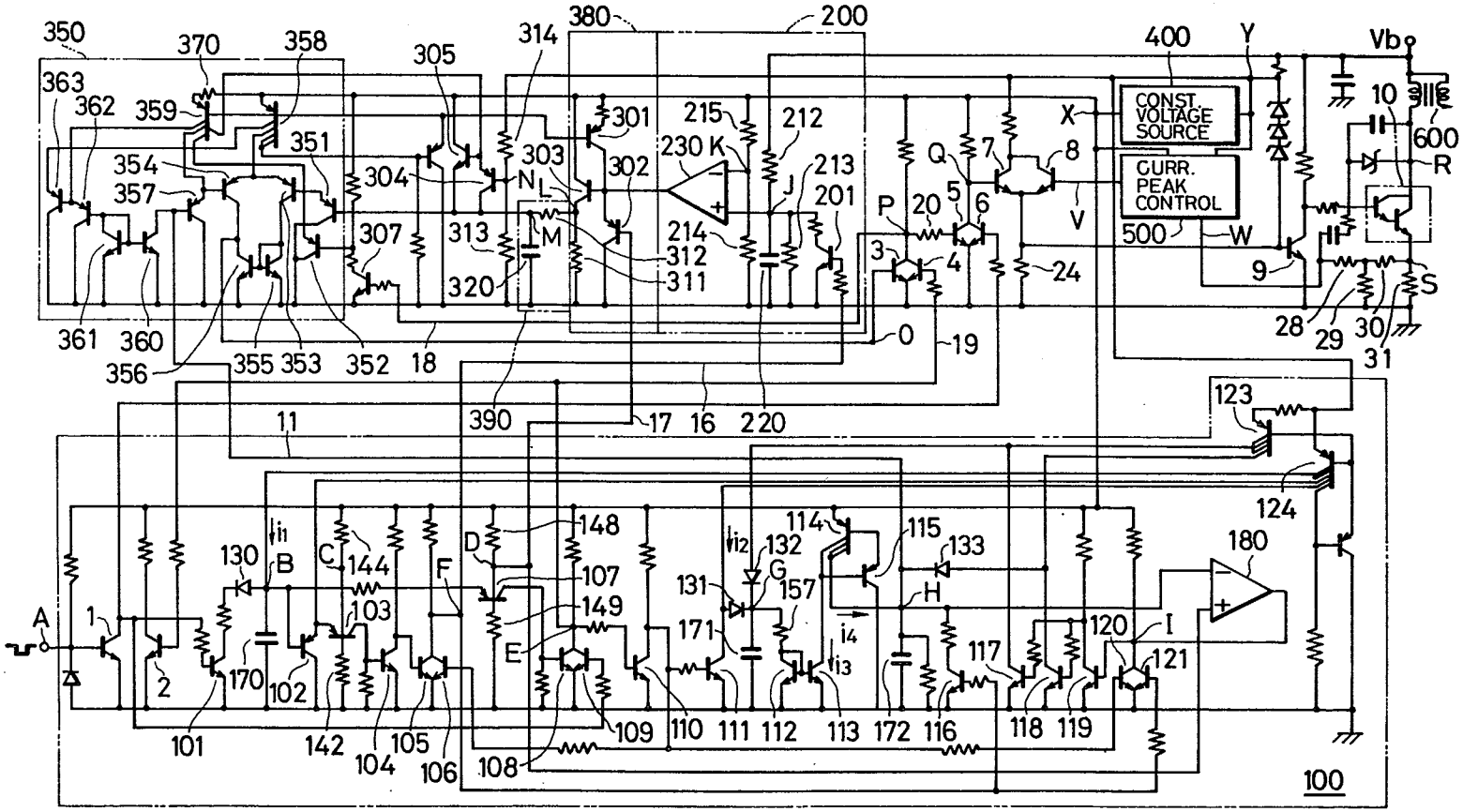
FIG. 1 is a circuit diagram of an embodiment of the control circuit of the invention.

Referring now to FIG. 1, there is shown a preferred embodiment of the spark ignition pulse generator of the invention for internal combustion engines. The ignition pulse generator generally comprises a ramp generator 100 coupled to a conventional electronic ignition timing control unit (not shown), a constant duration pulse generator 200, a clamping circuit 380 which clamps the amplitude of the constant duration pulse to the peak value of the ramp voltage, an integrator 390 for integrating the clamped, constant duration pulse and applying it to a comparator 350 which compares the instantaneous value of the ramp voltagen with the integrated signal for providing a spark ignition pulse to the primary winding of an ignition coil 600.

Figure 2:
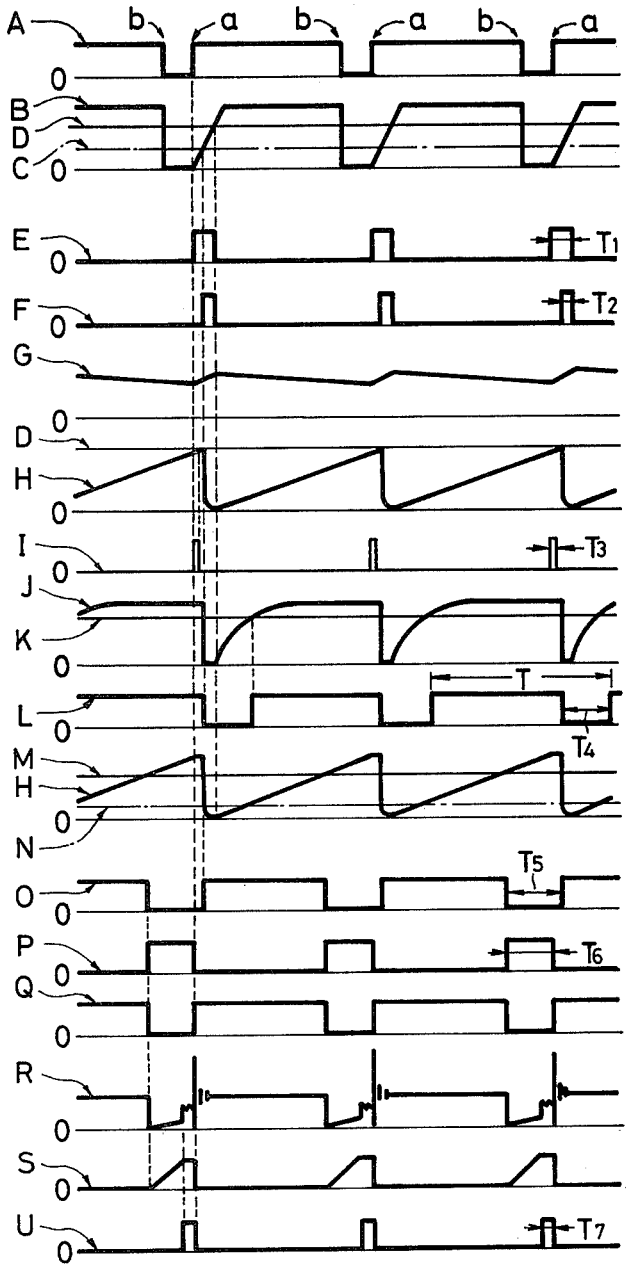
FIG. 2 is a waveform diagram useful for describing the operation of the invention.

In response to the application of an ignition timing pulse A (FIG. 2) a transistor 1 is rendered conductive to turn off a transistor 101 of the ramp generator 100. A capacitor 170 is charged by a constant current i1 supplied from a multi-collector transistor 124 to develop an increasing voltage B as seen in FIG. 2 in response to the leading edge transistion "a" of the ignition timing pulse A. When the voltage developed in the capacitor 170 reaches a level C determined by resistors 142 and 144, a transistor 102 is turned off, causing a transistor 103 to turn on and a transistor 104 to turn on and then transistor 105 to turn off. If the voltage B developed in the capacitor 170 reaches a higher level D equal to the voltage developed between resistors 148 and 149 plus the base-emitter voltage of a transistor 107, the latter is rendered conductive to turn on a transistor 108 which forms with a transistor 109 a NOR gate to generate a pulse E having a constant duration T1. The constant duration pulse E is inverted in polarity by a transistor 110 to turn off a transistor 111 during the interval T1 so that a capacitor 171 is charged through a diode 131 by a constant current i2 supplied from the transistor 124 with a current value equal to one-half the current i1. The transistor 105 forms a NOR gate with a transistor 106 to generate a pulse F of a constant duration T2 in response to the voltage B reaching the reference voltage C. The capacitor 171 thus develops a voltage G which is proportional to the engine revolution speed. The voltage G is applied through a resistor 157 to a current mirror circuit formed by a pair of transistors 112 and 113 so that an engine speed proportional current i3 is generated in the transistor 113. The current i3 is converted into a current i4 twice the value of current i3 by means of transistors 114 and 115. The current i4, which is proportional to engine speed, is used to charge a capacitor 172 having the same capacitance value as capacitor 170, so that the capacitor 172 is charged at a rate proportional to engine speed and thus develops a ramp voltage H having a constant peak value regardless of the engine speed. The peak value of the ramp voltage is determined by the reference voltage D developed at the junction between resistors 148 and 149 plus the base-emitter voltage of transistor 107. The capacitor 172 is discharged rapidly through a short circuit provided by a resetting transistor 116 when the latter is biased into conduction in response to the leading edge transition of each pulse F which occurs at the collector of transistor 105 in response to each ignition instant "a".

The capacitor 172 is coupled to the inverting input of a comparator 180, the noninverting input of which is coupled to the junction between resistors 148 and 149 for making a comparison between the instantaneous value of the ramp voltage H and the voltage D corresponding to the peak value of the ramp voltage. The output of comparator 180 is coupled to the base of a transistor 190 and to the collectors of transistors 120 and 121. The transistor 120 having its base coupled to the collector of the transistor 110 remains conductive to short the output of the comparator 180 until transistor 120 is biased off by transistor 110 for the interval T1. When the engine is accelerated, the ignition instant "a" would advance in time and therefore the ramp voltage H would be still lower than the constant voltage D at the instant "a". As a result, a high voltage at the output of the comparator 180 biases the transistor 119 into conduction for an interval T3. The conduction of transistor 119 turns off transistors 117 and 118 to allow the capacitors 171 and 172 to be charged through diodes 132 and 133, respectively, with a constant current supplied from multi-collector transistor 123 during the period T3. Therefore, the voltages G and H are increased by an amount that compensates for the increase in engine speed.

The constant duration pulse generator 200 includes a capacitor 220 which is normally charged through a resistor 212 and a transistor 201 having its base coupled through a line 16 to the collectors of transistors 105, 106 of the ramp generator 100 through a line 16. Transistor 201 is turned on in response to a pulse F to provide a discharge path to rapidly discharge the capacitor 220. At the trailing edge of the pulse F, the capacitor 220 is again charged at a time constant rate determined by resistors 212, 213 and capacitor 220 and the source voltage so that it builds up a voltage J which is applied to the noninverting input of a comparator 230 for making a comparison with a reference voltage K developed at a junction between resistors 214 and 215 which are coupled in series to a constant voltage source 400. The comparator 230 thus generates an output pulse having a duration determined by the voltage supplied from the source 400 in response to the leading edge transition "a" of each input timing pulse A.

The output of the comparator 230 is coupled to a clamping circuit 380 formed by transistors 301 and 302 having their conductive paths connected in series between the voltage source 400 and ground. The circuit junction between transistors 301 and 302 is coupled, on the one hand, to the output of comparator 230 and, on the other hand, to the base of an emitter-follower transistor 303 having its emitter coupled to ground by a resistor 311 which is in shunt with an integrator circuit 390 formed by a resistor 312 and a capacitor 320. The base of transistor 302 is coupled by a line 17 to the circuit junction between resistors 148 and 149 of ramp generator 100 so that the output voltage of the comparator 230 is clamped to the voltage D which is the peak value of the ramp voltage as previously described.

The transistor 303 serves to invert the polarity of the constant duration pulse from comparator 230. At the emitter of transistor 303 is thus developed a train of pulses L having the same pulse height as voltage D with a constant pulse spacing T4 corresponding to the pulse duration of the output of comparator 230. The pulses L are integrated by the integrator circuit 390 into a DC voltage M which appears at the circuit junction between resistor 312 and capacitor 320. Therefore, the integrated voltage M is inversely proportional to engine speed. Voltage M is coupled to a transistor 351 of the comparator 350 for comparison with the ramp voltage H applied through a line 11 from the capacitor 172 to the base of transistor 357. Comparator 350 provides output pulses 0 with a spacing T5 having the same duration as T4 but occur during the time prior to the ignition instant "a" as seen in FIG. 2 and supplies the pulses 0 to the base of a transistor 3. Since the rate of increase in ramp voltage H is proportional to engine speed while the voltage M is inversely proportional thereto, the pulse duration T5 has a constant value regardless of variations in engine speed. If, during engine high speed operations, the voltage M decreases below a reference level N established by resistors 313 and 314 which are coupled in series between a source voltage Vb through resistor 32 and ground, the decrease in voltage M is compensated for by the action of transistors 304 and 305, whereby the voltage M is clamped to the reference level N and therefore the duty ratio of the output of comparator 350 is maintained constant when the engine is operated at excessively high speeds. Since the reference voltage N is variable with the source voltage Vb, the duty ratio of the comparator 350 output is rendered inversely variable as a function of the source voltage during such high engine speed operations.

The detail of the operation of the comparator 350 is given as follows. When the base potential of transistor 357 reaches the base potential of transistor 351, the transistor 357 is turned off to turn off transistor 354. As a result, transistors 351 and 353 are turned on, so that the collector voltage of transistor 356 is switched to a low voltage level. The comparator 350 includes transistors 358 and 359 which form constant current sources for the transistors 353, 354. Further included are transistors 360, 361 and 363 which provide an offset current that cancels the bias current of transistors 354 and 357 which might charge the capacitor 172. Transistors 307 and 352 are coupled so that they provide a feedback path 18 to the collectors of transistor 3 to the base of which the output of comparator 350 is supplied. With this circuit arrangement the comparator 350 has a hysteresis characteristic that prevents it from erratically switching its output state in response to an input which fluctuates about the threshold. The transistor 3 forms a NOR gate with a transistor 4 having its base coupled through a line 19 to the collectors of transistors 108, 109 of the ramp generator 100 to generate a train of pulses P with a duration T6 to correct the deviation of ignition timing. Specifically, the pulse duration T6 is theoretically equal to T5−(T1−T2). However, for practical purposes T6 can be considered substantially equal to T5 since T1−T2 is of a negligibly small constant value (approximately 100 microseconds). The pulses P at the collectors of transistors 3 and 4 are inverted in polarity by a transistor 5 into pulses Q which are applied to the base of an emitter-follower transistor 7. The emitter of transistor 7 is coupled to ground by a resistor 23 to drive a Darlington power transistor amplifier 10 so that the latter is rendered conductive during the period T6 to generate an ignition current in the primary winding of an ignition transformer 600.

In a preferred embodiment, a resistor network formed by resistors 29, 30 and 31 is coupled in series to the emitter of the power amplifier 10 to develop a voltage corresponding to the primary current. This voltage is coupled through a resistor 28 to a current peak control circuit 500 to permit it to detect when the primary current exceeds a predetermined current value and turn on a transistor 8 so that the latter provides a conductive path of a relatively low conductivity to resistor 24 for the purpose of decreasing the base current of power transistor 10, whereby the primary current is precisely controlled to the predetermined value. This feedback operation could be omitted, if desired, since the primary current tends to have a uniform value due to the fact that the duration of this current generally corresponds to the pulse duration determined by the circuit 200.

The embodiment of FIG. 1 is modified to additionally include a feedback circuit shown in FIG. 2. This feedback circuit comprises a compensation circuit 395 formed by a transistor 308 having its base coupled to the base of transistor 302 of the clamp circuit 380 and a transistor 309 having its base coupled through the emitter-collector path of transistor 308 to ground, the circuit junction between the base of transistor 309 and the emitter of transistor 308 is coupled to a collector of a multi-collector transistor 401 which replaces the transistor 301 of the previous embodiment. The X terminal of the constant voltage source 400 is connected through the collector-emitter path of transistor 309 and resistor 319 to the junction between the resistor 312 and capacitor 320 of integrator 390. As will be described the current peak control circuit 500 provides pulses U with a duration T7 to the base of transistor 309. With the application of a pulse U the transistor 309 is turned on charging the integrating capacitor 302 via resistor 319, so that the voltage M increases as a function of the pulse duration T7. As a result, pulse spacing T5 becomes smaller than pulse duration T4 and this in turn causes a reduction in pulse duration T7. Hence the primary dwell time of the ignition transformer 600 can be reduced to a value just needed to effect ignition. It is noted that the power consumed during the peak period T7 of current pulse S does not contribute to the generation of useful power for ignition. Therefore, the current peak control circuit 500 minimizes the amount of ignition power.

Alternatively, instead of modifying the integrated voltage M this can be done by modifying the rate of increase in ramp voltage H with the compensation circuit 395.

Figure 4:
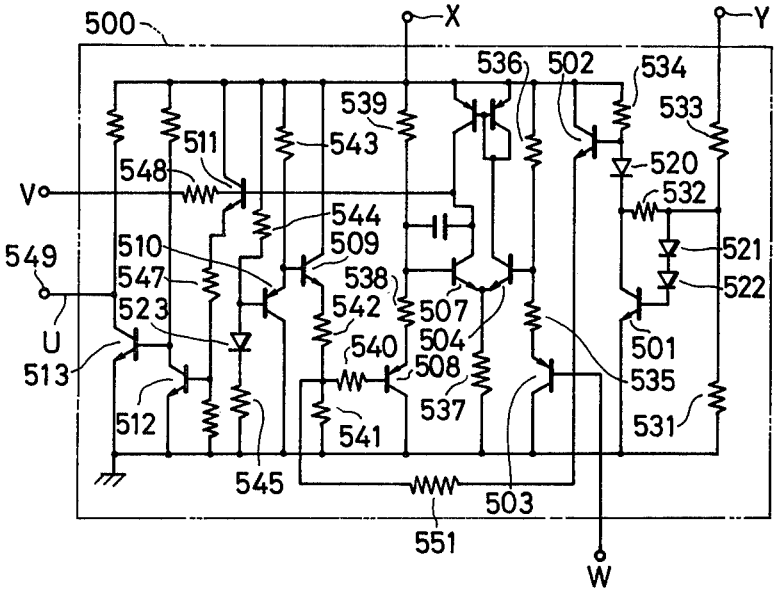
FIG. 4 is a circuit diagram of the current peak control circuit of FIG. 3.

FIG. 4 is an illustration of the detail of current peak control circuit 500. The source voltage Vb is supplied via terminal Y to a voltage divider formed by resistors 533 and 531, between which the junction is coupled by diodes 521, 522 to the base of a transistor 501 and further coupled by a resistor 532 to ground through the collector-emitter path of transistor 501. A resistor 534 and a diode 520 are connected in series to the collector of transistor 501 to bias the base of a transistor 502 to provide a constant voltage through a resistor 551 to a circuit junction between resistors 541 and 542. The voltage detected by the ignition current detecting resistor network is applied to a terminal W and thence to the base of a transistor 503 having its emitter coupled by resistor 535 to the base of a transistor 504. The circuit junction between resistors 541 and 542 is coupled by resistor 540 to the base of a transistor 508 of which the emitter-collector path is connected in a circuit including resistors 538 and 539, the junction between resistors 538 and 539 being coupled to the base of a transistor 507. The emitters of transistors 504 and 507 are coupled by a common resistor 537 to ground. The base of transistor 508 is impressed with a reference voltage with which the voltage detected in response to the ignition primary current is compared. This reference voltage is generated by a circuit including resistors 544, 545, diode 523, a transistor 510 having its base coupled to a junction between resistor 544 and diode 523, the emitter of transistor 510 being coupled to the base of a transistor 509. The collector-emitter path of transistor 509 is connected in series with the resistors 542 and 541.

Figure 3:
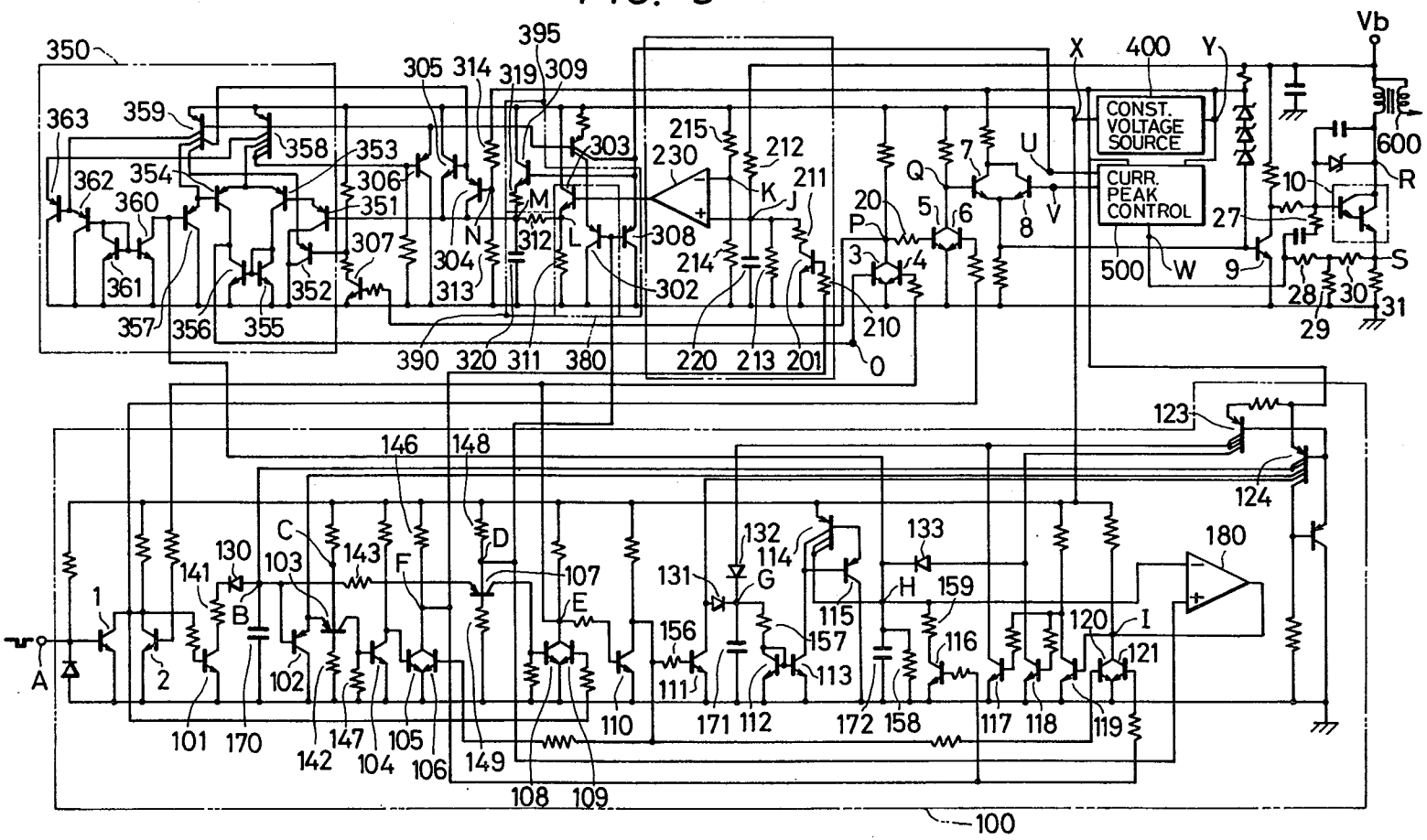
FIG. 3 is a circuit diagram of a modified embodiment.

The voltage applied to terminal W increases in proportion to the primary current value. When this voltage reaches said reference voltage, transistor 503 is turned off causing transistor 507 to turn off, so that the voltage at the collector of transistor 507 increases to thereby turn on transistors 8 and 9 of FIG. 3. This results in a decrease in current to the base of power transistor 10 so that the ignition primary current is controlled to the predetermined value. The rise in voltage at the collector of transistor 507 turns on transistors 511 and 512 and turns off transistor 513. The collector of the transistor 513 is connected to terminal 549 at which pulses U appear. As illustrated in FIG. 2, the primary current S that flows into the emitter of transistor 10 is generated in response to the falling edge of a pulse Q developed at the collectors of transistors 5, 6 with a linearly increasing rate until it reaches a predetermined peak level whereupon the current value is maintained constant. Ignition primary voltage signal R, developed at the collector of transistor 10, decreases rapidly in response to the falling edge of the pulse Q and then increases rapidly in response to the termination of the primary current S.

The embodiments shown and described above show only preferred forms of the invention. Various modifications and additions are readily apparent to those skilled in the art without departing from the scope of the invention which is only limited by the appended claims. For example, the ignition trigger timing could also be obtained from the instant "b" in FIG. 2, or from a cylinder position sensor as employed in electronic ignition control systems.

What is claimed is:

1. A circuit arrangement for controlling the dwell time of current flowing in the primary winding of an ignition transformer in response to the ignition timing of an internal combustion engine, comprising:

first means responsive to said ignition timing for generating a ramp voltage having a constant peak value and a variable rate of increase in voltage as a function of the speed of said engine;

second means for successively generating a pulse having a pulse height substantially equal to the peak value of said ramp voltage and a pulse duration variable inversely as a function of the speed of said engine;

third means coupled to said second means for integrating said pulses supplied thereto to generate an integrated output; and fourth means for comparing the instantaneous value of said ramp voltage with said integrated output to detect a difference therebetween and causing an ignition current to flow in said primary winding for a period corresponding to said difference.

2. A circuit arrangement as claimed in claim 1, wherein said first means comprises:

a capacitor;

means for generating a current substantially proportional to the speed of said engine; and means for charging said capacitor with said engine speed proportional current and discharging the capacitor in response to said ignition timing.

3. A circuit arrangement as claimed in claim 1, wherein said second means comprises:

means for generating a constant-duration pulse in response to said ignition timing; and means for inverting the polarity of said constant-duration pulse and clamping the pulse height of said polarity inverted pulse to the peak value of said ramp voltage.

4. A circuit arrangement as claimed in claim 1, 2 or 3, further comprising feedback control means including:

current sensing means for sensing a current generated in the primary winding of said transformer and generating therefrom a corresponding voltage signal;

comparing means for comparing said voltage signal with a reference voltage to detect a difference therebetween; and control means for controlling the period of said ignition current in accordance with the output of said comparing means so that the last-mentioned difference is is reduced to a minimum.

5. A circuit arrangement as claimed in claim 4, wherein said control means comprises means for controlling said integrated output in accordance with the last-mentioned difference.

6. A circuit arrangement as claimed in claim 2, wherein said first means comprises:

a second capacitor;

means for generating a constant-duration pulse in response to said ignition timing and charging said second capacitor with the constant-duration pulse to develop a voltage in said second capacitor proportional to the speed of said engine;

means responsive to said ignition timing for comparing the instantaneous value of said ramp voltage with a reference voltage corresponding to the peak value of said ramp voltage to detect a difference therebetween at the instant of said ignition timing and generating an output pulse having a duration correspoding to the last-mentioned difference; and means for charging the first-mentioned capacitor and said second capacitor in response to said output pulse.

7. A circuit arrangement as claimed in claim 1, further comprising means for clamping said integrated output to a constant value when the integrated output decreases below said constant value.

8. A circuit arrangement for controlling the dwell time of current flowing in the primary winding of an ignition transformer in response to the ignition timing of an internal combustion engine, comprising:

ramp voltage generating means responsive to said ignition timing for generating a ramp voltage having a constant peak value and a variable rate of increase in voltage as a function of the speed of said engine;

pulse generating means for successively generating a second pulse having a pulse height substantially equal to the peak value of said ramp voltage and a pulse duration variable inversely as a function of the speed of said engine;

integrating means for integrating said second pulses to generate an integrated output;

current sensing means for sensing a current generated in the primary winding of said transformer and generating therefrom a corresponding voltage signal;

first comparing means for comparing said voltage signal with a reference voltage to detect a difference therebetween;

correcting means for modifying said integrated output in accordance with said difference;

second comparing means for comparing the instantaneous value of said ramp voltage with said modified integrated output to detect a difference therebetween; and current generating means for causing an ignition current to flow in said primary winding for a period corresponding to the difference detected by said second comparing means.

9. A circuit arrangement for controlling the dwell time of current flowing in the primary winding of an ignition transformer in response to the ignition timing of an internal combustion engine, comprising:

current sensing means for sensing a current generated in the primary winding of said transformer and generating therefrom a corresponding voltage signal;

first comparing means for comparing said voltage signal with a reference voltage to detect a difference therebetween;

ramp voltage generating means responsive to said ignition timing for generating a ramp voltage having a constant peak value and a variable rate of increase in voltage as a function of the speed of said engine and as a function of said difference;

pulse generating means for successively generating a second pulse having a pulse height substantially equal to the peak value of said ramp voltage and a pulse duration variable inversely as a function of the speed of said engine;

integrating means for integrating said second pulses to generate an integrated output;

second comparing means for comparing the instantaneous value of said ramp voltage modified by said correcting means with said integrated output to detect a difference therebetween; and current generating means for causing an ignition current to flow in said primary winding for a period corresponding to the difference detected by said second comparing means.

* * * * *